US005539946A

United States Patent [19]

Kawada

[11] Patent Number: 5,539,946

[45] Date of Patent: Jul. 30, 1996

[54] TEMPORARY STIFFENING GIRDER FOR SUSPENSION BRIDGE

[75] Inventor: Tadaki Kawada, Musashino, Japan

[73] Assignee: Kawada Industries, Inc., Tokyo, Japan

[21] Appl. No.: 293,876

[22] Filed: Aug. 19, 1994

[30] Foreign Application Priority Data

Sep. 1, 1993 [JP] Japan ..... 5-239264

[51] Int. Cl.[6] ..... E04C 3/02

[52] U.S. Cl. ..... 14/18; 188/378

[58] Field of Search ..... 14/17–23; 52/724, 52/725, 727; 104/89, 115, 117, 119, 123; 188/378, 269

[56] References Cited

U.S. PATENT DOCUMENTS 4,665,578 5/1987 Kawada et al. .

FOREIGN PATENT DOCUMENTS 44-64623 11/1972 Japan .
58-229467 9/1985 Japan .
63-134701 5/1988 Japan .

*Primary Examiner*—Ramon S. Britts
*Assistant Examiner*—Pamela A. O'Connor
*Attorney, Agent, or Firm*—Frishauf, Holtz, Goodman, Langer & Chick

[57] ABSTRACT

The stiffening girder type suspension bridge according to the present invention is designed with a smaller dead load under normal conditions, and applied with a temporary dead load as an additional mass to improve the static characteristics and aerodynamic stability when the bridge is subjected to particularly violent storms that result in significant vibrations and swaying of the bridge. The present invention bridge structure is highly economical. A passage is provided in the stiffening girder at the center of its width along the direction of the bridge axis, so that a temporary dead load as an additional mass can be moved into the passage. Under normal conditions, the passage is kept empty of the load. When an imminent storm is anticipated, a given amount of liquid or solid is transferred into the passage located within the stiffening girder to temporarily apply a given amount of temporary dead load to the stiffening girder during a storm to control vibrations of the bridge caused by the winds.

9 Claims, 5 Drawing Sheets

TEMPORARY STIFFENING GIRDER FOR SUSPENSION BRIDGE

BACKGROUND OF THE INVENTION AND RELATED ART STATEMENT

The present invention relates to a suspension bridge, and more particularly, to the structure of a suspension bridge of which static characteristics and aerodynamic stability are improved by applying a temporary dead load as an additional mass when the bridge is exposed to conditions such as violent storms that would cause particularly rigorous swaying of the suspension bridge.

As a countermeasure against strong winds, suspension bridges are provided with an additional mass such as water and concrete in the stiffening girder to control the vertical and torsional vibrations of the girder. Such suspension bridges are known from, for example, Japanese Patent Publication Sho 47-44944, Japanese Patent Application Laid-open Sho 60-192007, U.S. Pat. No. 4,665,578, and Japanese Patent Application Laid-open Sho 63-134701.

Suspension bridges disclosed in JP Publication Sho 47-44944 and JPA Laid-open Sho 63-134701 utilize the dynamic energy of water pooled in advance in the stiffening girder to absorb the vertical and torsional vibrations of the girder during a storm, while those according to JPA Laid-open Sho 60-192007 and U.S. Pat. No. 4,665,578 reduce such vertical and torsional vibrations by arranging a prefixed amount of additional mass in the girder.

These bridge structures all utilize an additional mass such as water and concrete placed in the stiffening girder or the tower columns to reduce the vertical and torsional vibrations in the girder. As such, the additional mass is included as a part of the design dead load.

Generally, bridges are designed by considering the normal conditions when the dead load and the live load mainly of moving vehicles are working, and the stormy conditions when the wind load as well as the dead load play a vital role. The smaller the dead load of the main cable, anchors, towers, hangers, etc. that are designed by considering the vertical load, the better it is in terms of economy under the normal conditions. Conversely, the heavier the dead load, the static characteristics and aerodynamic stability against vibrations improve under stormy conditions. In the case of a stiffening girder of suspension bridge which is mainly designed to safeguard against stormy conditions, the girder can be made smaller in sectional area if a heavier temporary dead load is assigned, which in turn contributes to cost reduction of the girder itself.

Conventional countermeasures of applying an additional mass of water, concrete or the like to the stiffening girder in advance as the dead load are defective in that economical advantages of the main cable, anchors, towers and hangers that are designed based on the vertical loads under the normal conditions are sacrificed because of the increased dead load.

SUMMARY OF THE INVENTION

In view of the problems associated with the conventional countermeasures against winds employed in suspension bridges, the present invention aims at providing a suspension bridge of which the dead load under the normal conditions is designed as light as that under the stormy conditions when the live load is not imposed, and in which such dead load is temporarily increased only when the bridge is subject to stormy conditions.

As a means to achieve the above mentioned object, the present invention comprises a main cable, anchors to retain the tensile force generating at the main cable, plural towers supporting the main cable, a stiffening girder to distribute the live load working on the bridge floor, hangers to suspend the stiffening girder from the main cable and a passage for transferring the temporary dead load in the direction of the bridge axis at the center of the girder width only when strong winds are blowing.

As a temporary dead load to give an additional mass in a given amount, liquid such as fresh or sea water can be used. In this case, a duct is provided in the girder along the length of the bridge, the duct being kept empty under the normal conditions. When a storm is anticipated, a required amount of water is supplied from a water supply facility located on the land to fill the duct, to thereby apply a given amount of additional mass on the girder in the direction of the bridge axis near the center of the girder width. After the storm is gone, water inside the duct can be drained to restore the load on the girder to the initial level. The additional dead load should weigh at least as much as the live load and about 50% at the maximum of the product obtained by multiplying the dead load under the normal conditions with the ultimate strength factor of 1.5.

Examples of medium acting as an additional mass of the stiffening girder may include vehicles such as trains, tramcars and trailers loaded with liquid such as water or with solid such as soil and sand, stone, concrete or metal. In this case, a railway or a passage for such vehicles is provided in the girder along the length of the bridge, while said vehicles loaded with the required amount of liquid or solid may be on standby at a ground station or in a tunnel. Under the normal conditions, said passage provided in the girder is left empty. When a storm is anticipated, said vehicles are moved into the passage within the girder, so that a given amount of additional mass is applied on the girder near the center of its width in the direction of the bridge axis. When the storm is gone, the vehicles may be removed from the passage and returned to their original location on the ground to remove the additional mass and to restore the girder to the original state.

The suspension bridge according to the present invention can be designed with a smaller dead load as the girder is applied with an additional mass of a given weight only when necessary during a storm. The cost of making the main cable, anchors, towers and hangers that are designed based on the vertical loads under the normal conditions can therefore be reduced. On the other hand, the static characteristics and aerodynamic stability against strong winds can be improved, contributing to improved economy of the bridge as a whole.

DETAILED DESCRIPTION OF THE PREFERRED EMBODIMENTS

Figure 1:
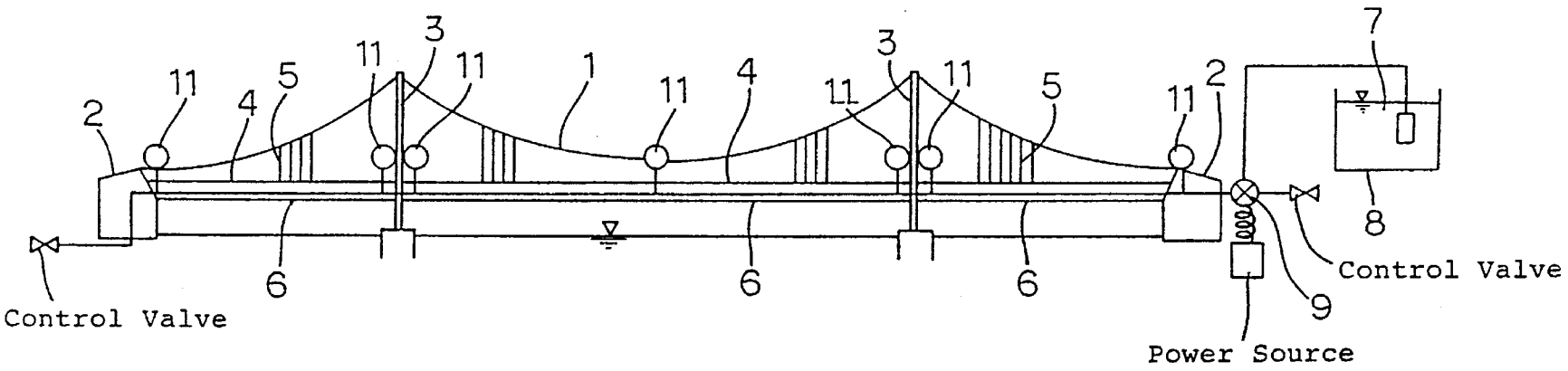
FIG. 1 is a side view to show the stiffening girder type suspension bridge according to the present invention wherein liquid is used as a temporary dead load.

Construction of the suspension bridge according to the present invention will now be described referring to embodiments shown in the drawings. FIG. 1 is a side view of the suspension bridge according to one embodiment, the bridge comprising a main cable 1, anchors 2 to retain the tensile force occurring at the main cable 1, a plurality of towers 3 to support the main cable 1, a stiffening girder 4 to distribute the live load acting on the bridge floor, and hangers 5 to suspend the girder 4 from the main cable 1.

The stiffening girder 4 is provided with a passage 6 that allows temporary application and distribution of an additional mass over the entire length of the girder in the direction of the bridge axis at the time of storm. An additional mass of any suitable temporary dead load such as liquid or solid is applied via the passage.

In the embodiment shown in FIG. 1, liquid, and more preferably fresh or sea water 7, is used as the temporary dead load. In this embodiment, a duct 6 is provided over the entire length of the girder 4 in the axial direction of the bridge to supply the water 7. A tank 8 is provided on the ground near the anchor 2 to pool a given amount of said water 7 at all times. Normally, the duct 6 is kept empty. When a storm is anticipated and the bridge is closed, the water 7 in the tank 8 is discharged to fill the duct 6.

The bottom of the tank 8 is positioned at a level higher than the duct 6 to allow the water 7 in the tank 8 to spontaneously flow into the tank 6 without the use of a pump. If the circumstances do not allow positioning of the tank 8 at a higher level, a booster pump 9 may be used to supply the water 7 under pressure into the duct 6. Alternatively, the sea water may be directly pumped up from the sea into the duct 6.

Further, the tank 8 may be arranged on either end of the bridge near the anchor 2 to supply the water from both ends toward the mid point of the bridge. This substantially reduces the time required to fill or drain the duct 6. As it is necessary to evacuate or fill the air from/in the duct 6 whenever the water 7 is supplied/drained regardless of the method of water supply, air valves 11 are provided at appropriate places over the entire length of the duct 6.

Figure 2:
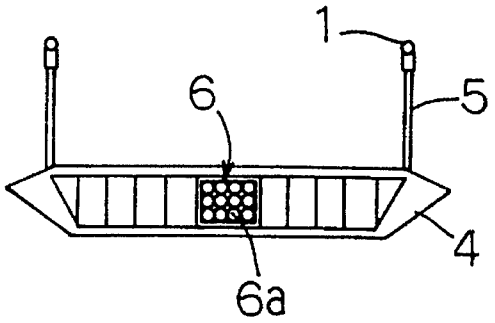
FIG. 2 is a sectional view to show the profile of the stiffening girder of the suspension bridge shown in FIG. 1.
Figure 3:
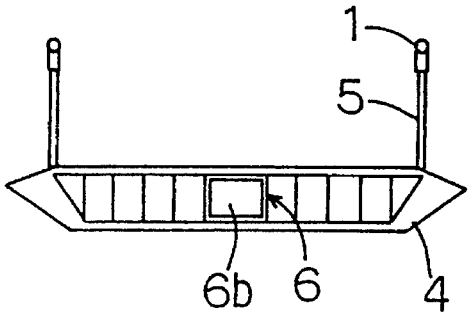
FIG. 3 is a sectional view to show the profile of the stiffening girder according to another embodiment of the invention.
Figure 4:
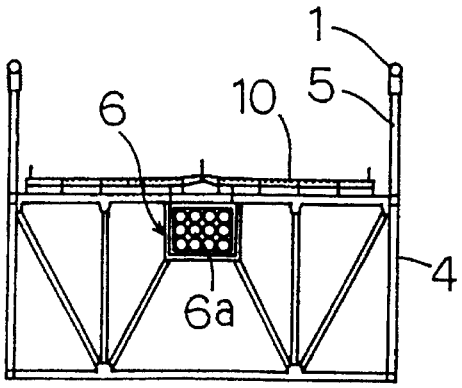
FIG. 4 is a sectional view to show the profile of the stiffening girder according to still another embodiment.

In case the stiffening girder 4 is of a box type, a plurality of water pipes **6*a* may be arranged within the girder 4 to extend along the entire length of the bridge and be supported in a continuous manner by the body of the box-like girder itself as shown in FIG. 2. Or, as shown in FIG. 3, water-tight partitions may be used to define a continuous water passage 6*b* within the girder 4. If the girder 4 is of a truss type as shown in FIG. 4, a plurality of water pipes 6*a* such as shown in FIG. 2 are suspended from the bottom face of the bridge floor 10. In any of the above cases, the duct 6** must be provided near the center of the girder width to prevent decrease of the number of torsional vibrations in order to assure the stability against wind.

Figure 5:
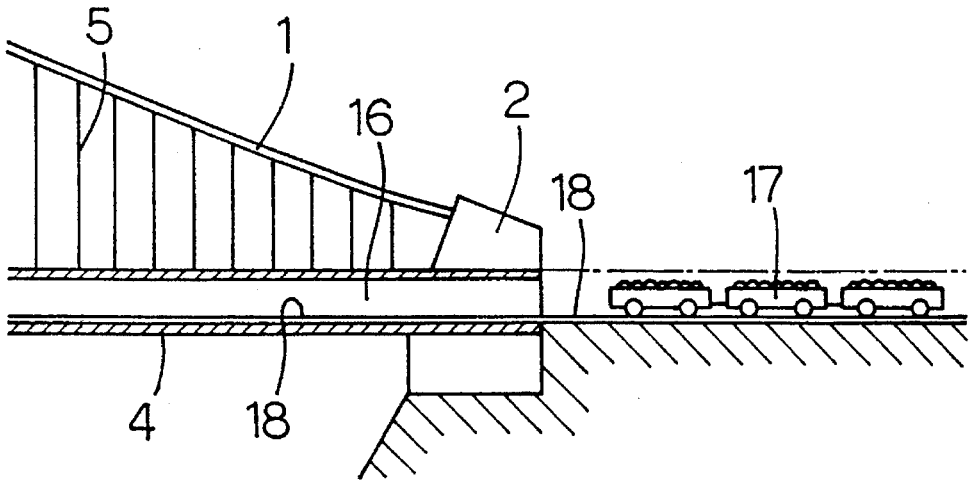
FIG. 5 is a partial side view of a stiffening girder type suspension bridge wherein loaded vehicles are used as a temporary dead load.
Figure 6:
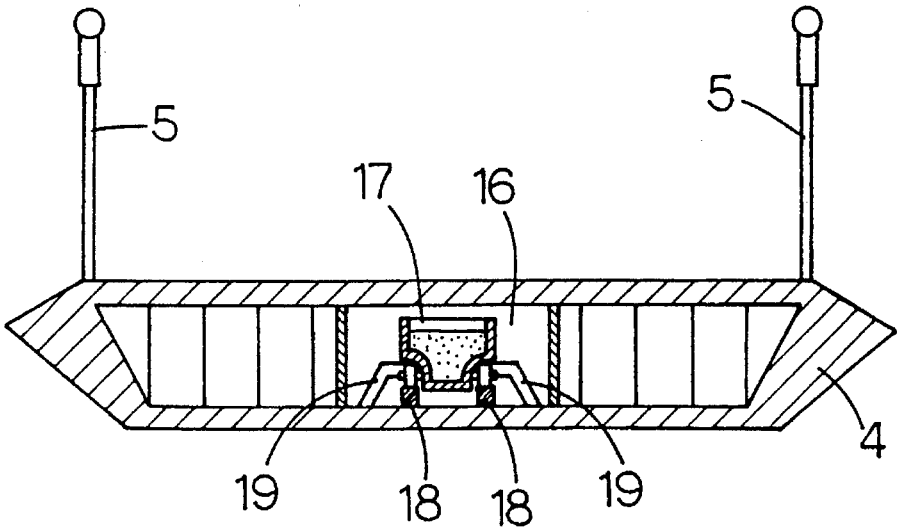
FIG. 6 is a sectional view to show the stiffening girder of the bridge shown in FIG. 5.

FIG. 5 shows another embodiment wherein vehicles 17 carrying liquid such as water or solid such as soil, sand, stone, concrete or metal, or both the liquid and the solid are used as the additional mass to give the temporary dead load. In this embodiment, a passage such as a railway track or roadway 16 for the vehicles 17 carrying said liquid or solid is provided in the stiffening girder 6 along the direction of bridge axis over the entire girder length. The vehicles 17 loaded with a given amount of liquid or solid are kept on standby at a depot on the ground or in the tunnel located near the anchor 2. Under the normal conditions, the passage 16 is kept empty as the vehicles 17 are on standby elsewhere. When the bridge is closed to traffic because of an imminent storm, the vehicles 17 are moved into the passage 16.

The passage 16 includes a railway track 18 extending along the entire bridge length and located within the section of the stiffening girder 4 and is formed as a tunnel having an inner diameter sufficient to accommodate the movement of the vehicles 17. It is preferable to provide lock devices 19 for securely holding the vehicles 17 in place on the railway track 18 to prevent the vehicles from derailing or running in the unintended direction when the stiffening girder 4 sways and swings due to the winds. It is noted that for the stability against wind, the passage 16 must be located near the center of the girder width to prevent the decrease of the number of torsional vibrations.

The vehicles 17 may be moved by means of an engine such as diesel engine or by a traction means. Under the normal conditions, the vehicles are kept on standby in the tunnel or at the depot located on the ground near the anchor 2, with the load of a given amount of liquid or solid. When a storm is anticipated, they are moved on the railway track 18 to a predetermined position in the passage 16 either by a traction means or by self-travelling. In case it is not possible to provide a passage 16 within the stiffening girder 4 or to move the vehicles 17 into the girder 4, the vehicles 17 may be moved on the bridge floor or on the railway track provided underneath the floor for inspection cars.

The greater the additional mass introduced into the duct 6 or the passage 16, the greater the resistance of the suspension bridge against the wind becomes. This is because the greater the tensile force of the cable 1, the static characteristics and aerodynamic stability improve in the bridge which is a structure suspended by said cable. Thus, the additional mass that can be applied may weigh at least as much as the live load. However, a preferable amount of the additional mass in terms of the ratio of the live load as against the deadload is 15% for a suspension bridge with the span in the order of 1,000 m, 9% with the span in the order of 2,000 m, and 5% with the span in the order of 3,000 m, respectively. It is not necessarily impossible to apply an additional mass which is about 50% of the product obtained by multiplying the dead load under the normal conditions with the ultimate strength factor of 1.5.

Figure 7:
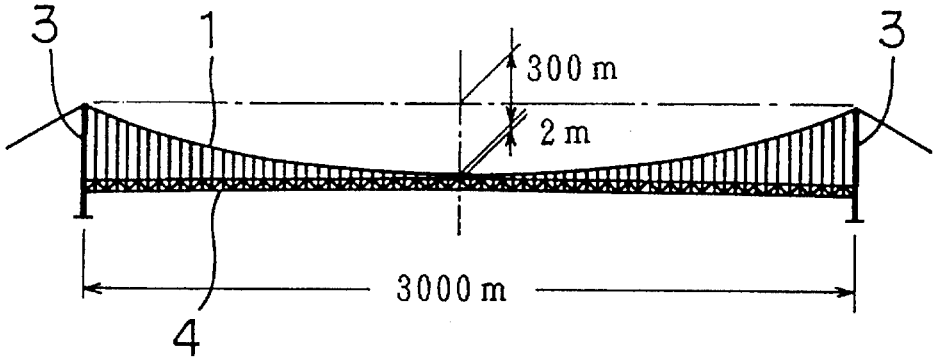
FIG. 7 is a side view to show the dimensions of a bridge on which calculation was based as one example of the present invention.
Figure 8:
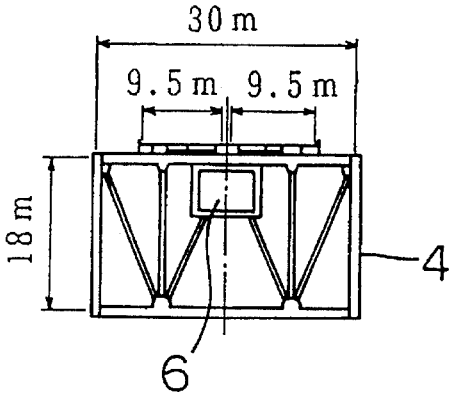
FIG. 8 is a sectional view of the bridge shown in FIG. 7.

FIG. 7 is a side view of a suspension bridge with a truss type stiffening girder having the span of 3,000 m. The calculations used in the present invention are based on the numerical values of the bridge of FIG. 7. FIG. 8 is its sectional view. Table 1 shows various input data of the sectional dimensions used in the calculations. It should be noted that the wind velocity differs depending on the location of the bridge. The design wind velocity is determined based on the basic design wind velocity of the site and considering the height and length, etc. of the structure. The design wind velocity acting on the girder is usually about 60 m/s.

TABLE 1

Sectional Values of Suspension Bridge Shown in FIGS. 7 & 8

| | | | Sectional Values |
|---|---|---|---|
| Weight | Cable | t/m/Br | 27.710 |
| | Stiffening girder | t/m/Br | 30.990 |
| | Total weight | t/m/Br | 58.700 |
| Polar Moment of Inertia | | $t = S^2 = m/m$ | 968.2 |
| Cable | Cable distance | m | 30.0 |
| | Sectional area of cable | $m^2/Br$ | 3.07 |
| | Cable sag | m | 300 |
| | Horizontal component of cable tension | t/Br | 220125 |
| Stiffening Girder | Vertical flexural rigidity | $t = m^2$ | $1.36 \times 10^9$ |
| | Horizontal flexural rigidity | $t = m^2$ | $3.78 \times 10^9$ |
| | Torsional rigidity | $t = m^2$ | $0.44 \times 10^9$ |

Figure 9A:
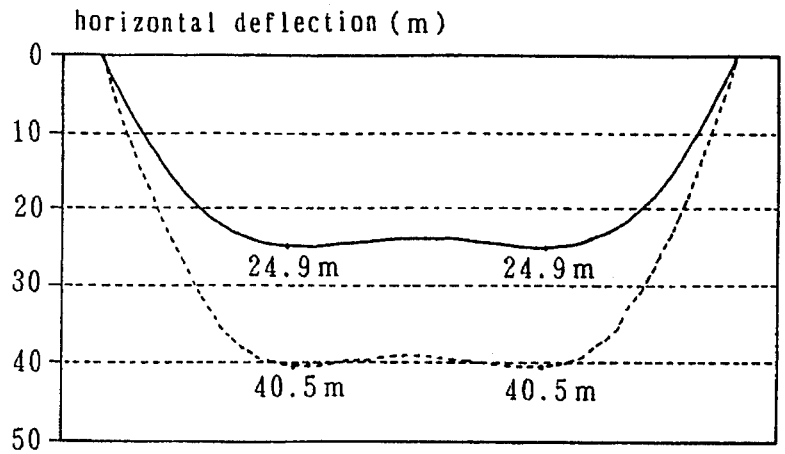
FIGS. 9A–9C show graphs comparing the difference in the calculated values between the cases with and without a temporary dead load.
Figure 9B:
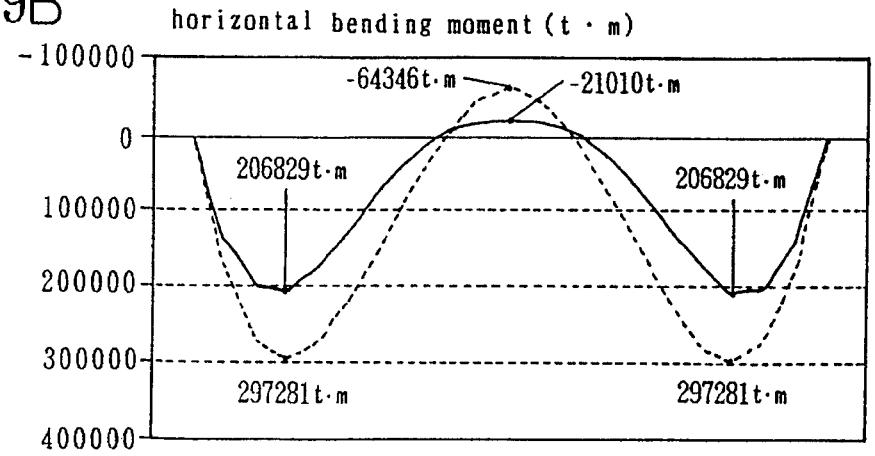
Figure 9C:
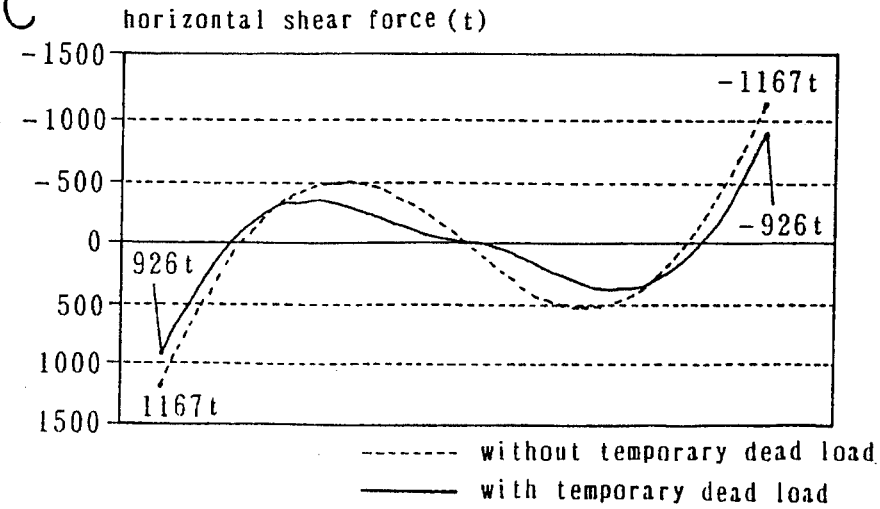

FIGS. 9A–9C show graphs to compare the horizontal deflection, bending moment and horizontal shear force of a suspension bridge with or without an additional mass of temporary dead load. It is assumed that the bridge has a lighter design dead load under the normal conditions and that a storm with the maximum wind velocity of 62 m/s acts on the girder horizontally. Table 2 shows various values related to the critical wind velocity at which flutter is likely to occur, a phenomenon observed in suspension bridges of greater dimensions.

TABLE 2

Critical Wind Velocity for Fluttering

| | Without temporary dead load | With temporary dead load |
|---|---|---|
| Vertical natural frequency (H2) (1st symmetric mode) | 0.0836 | 0.0734 |
| Torsional natural frequency (H2) (1st symmetric mode) | 0.1576 | 0.1602 |
| Polar moment of inertia ($t = m^2/m$) | 9489 | 9489 |
| Weight (t/m) | 58.70 | 93.36 |
| Critical wind velocity (m/s) | 65.8 | 78.8 |

As has been described in the foregoing, the suspension bridge according to the present invention is provided with a duct or a passage where an additional mass of temporary dead load comprising liquid or solid may be arbitrarily applied on the stiffening girder whenever necessary. Under the normal conditions, the duct or the passage is kept unloaded, so that the dead load of the bridge as a whole under the normal conditions can be reduced. This leads to economy of the main cable, anchor, towers and hangers that are designed based on the vertical loads under the normal conditions. During a storm, on the other hand, a temporary dead load of a given weight is promptly introduced into said duct or passage to impart a given amount of additional mass along the axis of the bridge near the center of the girder width. This improves the static characteristics and aerodynamic stability of even a bridge with essentially smaller dead load, resulting in economy of the materials as the weight of the bridge structure can be made lighter.

For example, as is evident from the graphs of FIG. 9 comparing the horizontal deflection, horizontal bending moment and horizontal shear force between a bridge with (solid line) and without (dotted line) temporary dead load during a storm, introduction of temporary dead load as an additional mass which is about 50% of the dead load will reduce the maximum horizontal deflection by 40%, the maximum horizontal deflection by 30% and the maximum shear force by 20%. It is understood from the graphs that decrease in the horizontal bending moment results in decreased weight of the cable material for the stiffening truss by about 30%. Of the total weight of 168,000 tons of the stiffening truss type girder with the center span of 3,000 m, a saving of about 6,000 tons can be achieved.

As is evident from Table 2 showing the critical wind velocity for the flutter which is of significance in extra long suspension bridges, the critical wind velocity increases by about 13 m/s when the temporary dead load is applied as compared with the value under no such additional load. This means a smaller torsion constant and reduction of material weight for the lateral structural elements; which is estimated to be about 10,000 tons in weight for a bridge with the span of 3,000 m.

In the case of a box type stiffening girder, the wind load acting on the girder is small because of the stream-lined configuration, and the horizontal bending moment on the girder is essentially small. When compared with a truss type stiffening girder, saving of the material by reduced horizontal bending moment is relatively small. Nevertheless, the critical wind velocity for the flutter does increase, which means that the torsion constant can be designed smaller and the girder height can be decreased, resulting in an economical design of the box type stiffening girder.

As a temporary dead load is applied only at the time of a storm, the weight of the stiffening girder can be greatly reduced. It may be pointed out that there will be a weight increase in the stiffening girder because of the construction of said duct or passage for the additional mass. However, if the stiffening girder is of a box type, the structural partitions can be utilized to define the duct or passage and to minimize the additional steel material necessary to construct such duct or passage. In the case of a stiffening girder of a truss type, construction of the duct or passage may increase steel weight. However, the increase is estimated to be equal to about 30% of the weight reduction of 6,000 tons of the entire bridge according to the present invention, and economic advantages of the present invention will not be impaired.

What is claimed is:

1. A stiffening girder type suspension bridge comprising:

a main cable, anchors retaining a tensile force on the main cable, a plurality of towers positioned between the anchors and supporting the main cable, a stiffening girder for distributing a live load acting on a floor of said bridge, hangers for suspending the stiffening girder from the main cable, and an empty passage means provided within the stiffening girder along the direction of a bridge axis at a center of a width of the girder for removably holding a temporary dead load as a given additional mass to be applied temporarily only at a time of a hurricane or a storm.

2. A stiffening girder type suspension bridge comprising:

a main cable, anchors retaining a tensile force on the main cable, a plurality of towers positioned between the anchors and supporting the main cable, a stiffening girder for distributing a live load acting on a floor of said bridge, hangers for suspending the stiffening girder from the main cable, and an empty passage means provided within the stiffening girder along the direction of a bridge axis at a center of a width of the girder for removably holding a temporary dead load as a given additional mass to be applied temporarily only at a time of a hurricane or a storm, wherein said temporary dead load as a given additional mass comprises a liquid that can flow in the empty passage means so as to be pooled therein or drained therefrom, and wherein said temporary dead load is at least equal in weight to the live load of the bridge and is a maximum of about 50% of a product obtained by multiplying said temporary dead load under normal conditions with an ultimate safety factor of 1.5.

3. The stiffening girder type suspension bridge as claimed in claim 2, wherein said liquid is water.

4. The stiffening girder type suspension bridge as claimed in claim 2, wherein said temporary dead load is water.

5. A stiffening girder type suspension bridge comprising:

a main cable, anchors retaining a tensile force on the main cable, a plurality of towers positioned between the anchors and supporting the main cable, a stiffening girder for distributing a live load acting on a floor of said bridge, hangers for suspending the stiffening girder from the main cable, and an empty passage means provided within the stiffening girder along the direction of a bridge axis at a center of a width of the girder for removably holding a temporary dead load as a given additional mass to be applied temporarily only at a time of a hurricane or a storm, wherein said temporary dead load as a given additional mass is comprised of vehicles that are movable in the empty passage, said vehicles carrying at least one of a liquid and solids, and wherein said temporary dead load to be applied during the time of a hurricane or a storm has a weight which is at least equal to a weight of the live load and is a maximum of about 50% of a product obtained by multiplying said temporary dead load under normal conditions with an ultimate safety factor of 1.5.

6. The stiffening girder type suspension bridge as claimed in claim 5, wherein said vehicles are selected from the group consisting of trains, tramcars and trailers.

7. The stiffening girder type suspension bridge as claimed in claim 5, wherein said liquid comprises water.

8. The stiffening girder type suspension bridge as claimed in claim 7, wherein said so, lid is selected from the group consisting of soil, sand, stone, concrete and metal.

9. The stiffening girder type suspension bridge as claimed in claim 3, wherein said vehicles carry both said liquid and said sold, and wherein said solid is selected from the group consisting of soil, sand, stone, concrete and metal.

* * * * *